US005950054A

United States Patent [19]

Kim

[11] Patent Number: 5,950,054

[45] Date of Patent: Sep. 7, 1999

[54] INK DELIVERY SYSTEM FOR LIQUID ELECTROPHOTOGRAPHIC COLOR PRINTER

[75] Inventor: Jong-woo Kim, Yongin, Rep. of Korea

[73] Assignee: Samsung Electronics Co., Ltd., Kyungki-do, Rep. of Korea

[21] Appl. No.: 09/106,901

[22] Filed: Jun. 30, 1998

[30] Foreign Application Priority Data

Feb. 27, 1998 [KR] Rep. of Korea ..... 98-6481

[51] Int. Cl.[6] ..... G03G 15/10

[52] U.S. Cl. ..... 399/237; 399/238; 399/249; 399/250

[58] Field of Search ..... 399/237, 238, 399/246, 247, 248, 249, 250, 251, 358, 359, 348, 62; 210/360.1, 380.1; 347/7, 93

[56] References Cited

U.S. PATENT DOCUMENTS

| | | | |
|---|---|---|---|
| 5,278,615 | 1/1994 | Landa | 399/237 X |
| 5,585,899 | 12/1996 | Palumbo et al. | 399/62 |
| 5,634,170 | 5/1997 | Knapp et al. | 399/358 X |
| 5,837,138 | 11/1998 | Boele | 210/360.1 |

*Primary Examiner*—Arthur T. Grimley
*Assistant Examiner*—Hoan Tran
*Attorney, Agent, or Firm*—Sughrue, Mion, Zinn, Macpeak & Seas, PLLC

[57] ABSTRACT

An ink delivery system for a liquid electrophotographic color printer delivers a developer liquid to a plurality of development units, and includes a plurality of circulation tanks containing developer liquid, connected to the respective development units; a plurality of jet portions for jetting the developer liquid in the circulation tanks to development gaps in the respective development units; a plurality of ink tanks having concentrated inks incorporated in a printer body; a plurality of agitators installed in the respective ink tanks for agitating the concentrated ink; a refill ink cartridge detachably installed in the printer body, for refilling the concentrated ink consumed in the ink tanks through a concentrated ink refill path; a plurality of concentrated ink supply paths to supply concentrated ink to the corresponding circulation tanks; a carrier tank containing carrier, which is fixed in the printer body; a carrier supply path through which the carrier is supplied to the respective circulation tanks; a waste ink disposal tank for collecting the waste ink in the circulation tanks; and a filtering mechanism for filtering the waste ink in the waste ink disposal tank to supply the carrier to the carrier tank.

7 Claims, 3 Drawing Sheets

INK DELIVERY SYSTEM FOR LIQUID ELECTROPHOTOGRAPHIC COLOR PRINTER

BACKGROUND OF THE INVENTION

1. Field of the Invention

The present invention relates to an ink delivery system for a liquid electrophotographic color printer, and more particularly, to an ink delivery system for a liquid electrophotographic color printer having a structure capable of recycling a liquid carrier separated from ink supplied through an ink supplier.

2. Description of the Related Art

In general, in an electrophotographic printer, a latent electrostatic image corresponding to various colors is formed on a photosensitive medium such as a photoreceptor belt by irradiating laser beams onto the photosensitive medium by a laser scanning unit (LSU), and then the latent electrostatic image is developed by supplying a developer liquid containing a toner mixed with a carrier, for the image to then be transferred to a sheet of print paper.

As shown in FIG. 1, a conventional development apparatus includes a plurality of laser scanning units (LSUs) for forming a color image corresponding to a latent electrostatic image on a photoreceptor belt 10, a drying/condensing unit 30 for drying/condensing a carrier remaining on the photoreceptor belt 10 after development, and an ink delivery system for supplying a developer liquid of a predetermined concentration and volume suitable for development and recovering a carrier condensed and dried by the drying/condensing unit 30 after being used in development.

The developer liquid is ink of a concentration of about 2–4 wt % obtained by mixing concentrated ink containing about 9 wt % powdered toner supplied from an ink cartridge 41 and a liquid carrier supplied from a carrier cartridge 43. The toner includes pigments indicating different colors, i.e., yellow (Y), magenta (M), cyan (C) and black (K) colors.

The ink delivery system includes a plurality of ink cartridges 41 in which concentrated ink corresponding to different colors is stored, a carrier cartridge 43 in which a carrier is stored, a plurality of circulation tanks 44 in which developer liquid of corresponding different colors is stored, and a plurality of jet portions 47 for jetting the developer liquid to development gaps G between development rollers 21 of the plurality of development units 20 and the photoreceptor belt 10 positioned corresponding thereto. The ink cartridge 41 includes an agitator 42, by which the concentrated ink accommodated therein is not precipitated, and is disposable and can be replaced when the concentrated ink is used up. Also, the carrier cartridge 43 is disposable and can be replaced when the carrier contained therein is used up.

The respective circulation tanks 44 are installed under the corresponding development units 20, and supply developer liquid through the jet portions 47 and receive the residual developer liquid after being used for development so that the developer liquid is continuously supplied to the development gap G during development. A concentration sensor 45 for sensing the concentration of the developer liquid contained in each of the circulation tanks 44 is installed in each of the circulation tanks 44. Also, an upper limit level sensor 46*a* and a lower limit level sensor 46*b* for sensing the amount of the developer liquid contained in the circulation tank 44 are installed in the upper and lower portions of each of the circulation tanks 44.

Each of the jet portions 47 includes a jet path 47*a* through which the developer liquid is supplied, a jet pump 47*b* installed in the jet path 47*a* for pumping the developer liquid, and a nozzle 47*c* installed at an end of near the development gap G for jetting the developer liquid to the development gap G.

The waste ink contained in the respective circulation tank 44 is exhausted to a waste ink disposal tank 49 via an exhaust path 48.

The drying/condensing unit 30 includes a drying roller 31 for absorbing the carrier remaining on the photoreceptor belt 10, regeneration rollers 33 for regenerating the absorbed liquid carrier into a vapor carrier by heating the drying roller 31 while rotating in contact with the drying roller 31, a condenser 35 for condensing the vapor carrier, and a condensation tank 37 for storing the carrier condensed by the condenser 35.

The carrier stored in the condensation tank 37 is supplied to the carrier cartridge 43 via a pump 39.

The amount of the concentrated ink and the carrier supplied from the ink cartridge 41 and the carrier cartridge 43 is determined by the concentration and volume of the developer liquid contained in the circulation tanks 44, sensed by the concentration sensor 45 and/or upper and lower limit level sensors 46*a* and 46*b*.

As described above, in the conventional ink delivery system for a liquid electrophotographic color printer, when the carrier is used up, the overall cartridge must be replaced.

Thus, to supply the carrier exclusively used for a liquid electrophotographic printer, a user must buy a carrier cartridge as well as an ink cartridge for replacement, which is costly and burdensome.

Also, when the concentrated ink is used up, the entire ink cartridge must be replaced. At this time, functional parts such as an agitator included in the ink cartridge must be altogether replaced, which as a whole, raises the cost of the ink cartridge.

SUMMARY OF THE INVENTION

To solve the above problem, it is an objective of the present invention to provide an ink delivery system for a liquid electrophotographic color printer, in which a carrier cartridge for supplying a carrier used for development is replaced with a carrier tank and a carrier is separated from concentrated ink supplied through an ink cartridge to then be recycled, Accordingly, to achieve the above objective, there is provided an ink delivery system for a liquid electrophotographic color printer which is capable of delivering a developer liquid of a predetermined concentration which is a mixture of a toner and a liquid carrier, to a plurality of development units, including a plurality of circulation tanks connected to the respective development units, and in which the developer liquids to be supplied to the development units are stored, a plurality of jet portions disposed between the respective circulation tanks and the respective development units, for jetting the ink in the circulation tanks to development gaps in the respective development units, a plurality of ink tanks incorporated in a printer body and in which concentrated ink having different colors is stored, a plurality of agitators installed in the respective ink tanks for agitating the concentrated ink, a refill ink cartridge detachably installed in the printer body, for refilling the concentrated ink consumed in the ink tanks through a concentrated ink refill path, a plurality of concentrated ink supply paths through which the concentrated ink accommodated in the respective ink tanks is supplied to the corresponding circulation tanks, a carrier tank fixed in the printer body and in which the carrier to be supplied to the respective circulation tanks is stored, a carrier supply path through which the carrier in the carrier tank is supplied to the respective circulation tanks, a waste ink disposal tank connected to the respective circulation tanks by an ink exhaust path, for collecting the waste ink in the circulation tanks, and filtering means installed between the waste ink disposal tank and the carrier tank, for filtering the waste ink in the waste ink disposal tank to supply the carrier to the carrier tank.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
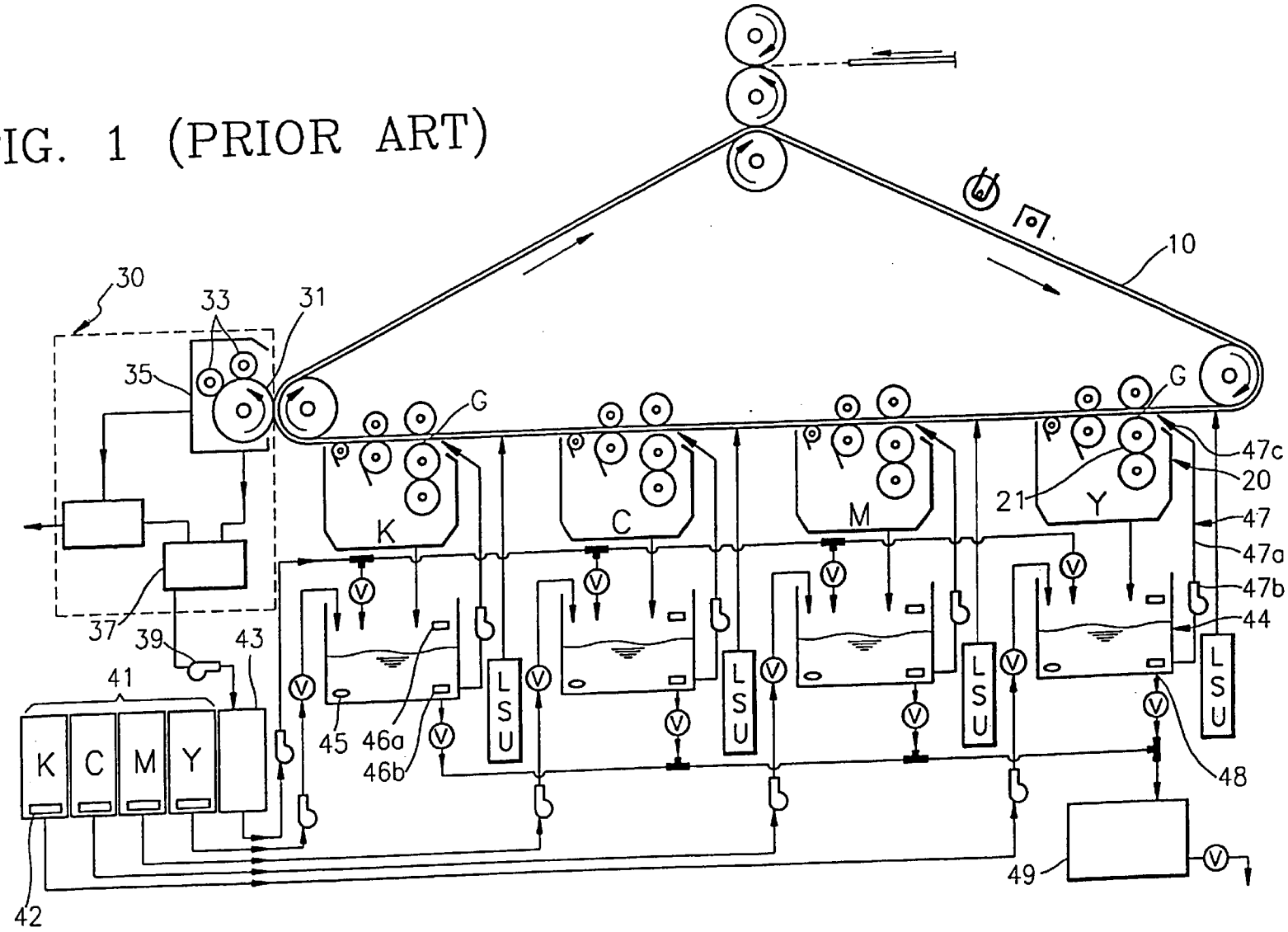
FIG. 1 (PRIOR ART)
FIG. 1 is a schematic diagram of a conventional ink delivery system for a liquid electrophotographic color printer.
Figure 2:
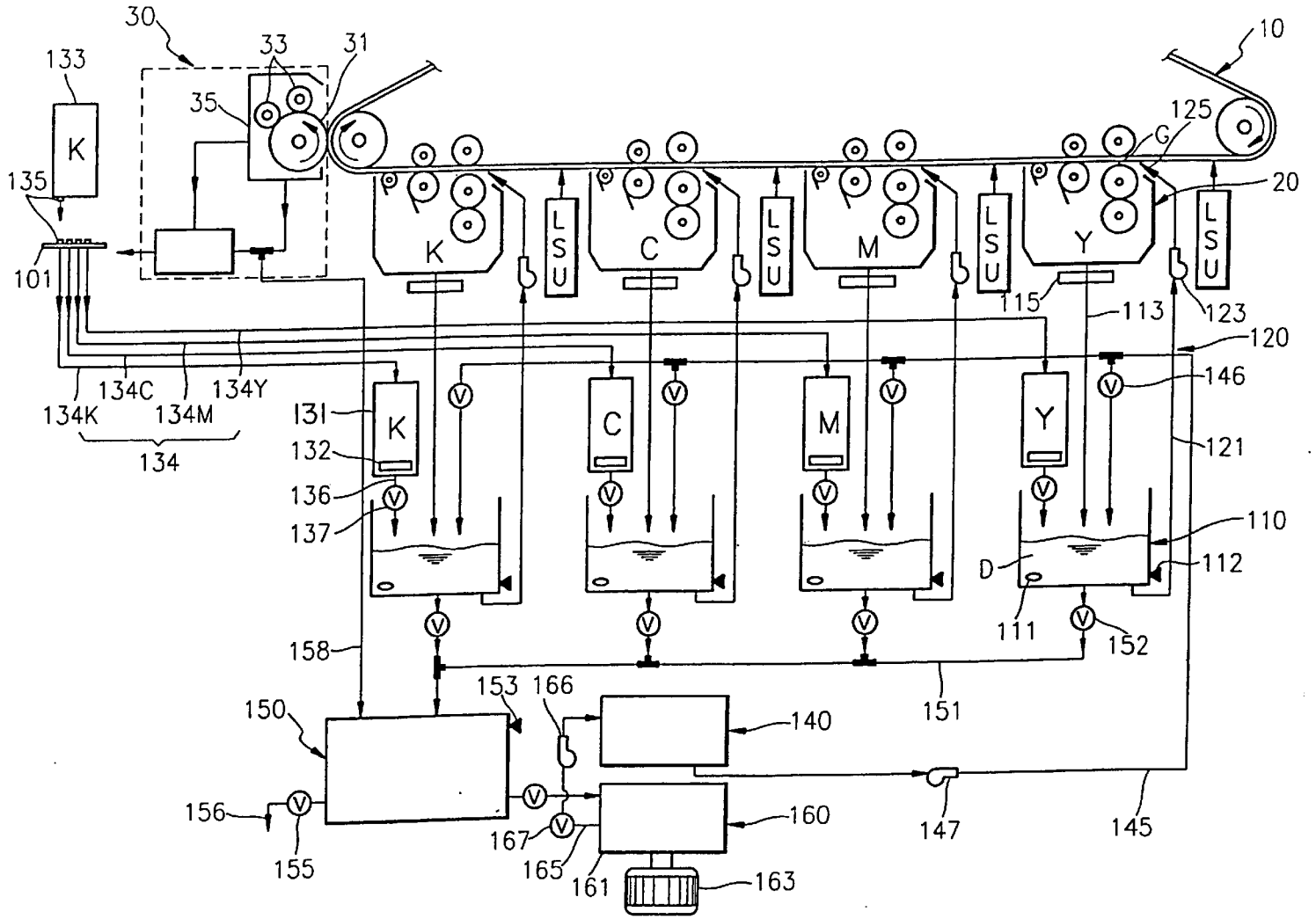
FIG. 2 is a schematic diagram of an ink delivery system for a liquid electrophotographic color printer according to an embodiment of the present invention.

Referring to FIG. 2, in an ink delivery system for a liquid electrophotographic color printer according to an embodiment of the present invention, differently colored developer liquid each having a predetermined concentration and volume so as to be suitable for development, are supplied to a plurality of development units 20, respectively. The carrier is condensed by a drying/condensing unit 30 after being used for development, and recovered. In this embodiment, for full-color implementation, ink of yellow (Y), magenta (M), cyan (C) and black (K) colors is used, by way of example.

The ink delivery system includes a plurality of circulation tanks 110 for supplying developer liquid D to a plurality of development units 20, a plurality of jet portions 120 for jetting the developer liquid D contained in the circulation tanks 110 to each development gap G of the plurality of development units 20, a plurality of ink tanks 131 in which concentrated ink corresponding to the respective colors is stored, a refill ink cartridge 133 for supplying the concentrated ink to the ink tanks 131, a carrier tank 140 in which a carrier is stored, a waste ink disposal tank 150 for collecting waste ink from the circulation tanks 110, and a filtering means 160 for filtering the waste ink in the waste ink disposal tank 150 and supplying a carrier to the carrier tank 140. Also, the system includes a plurality of paths connecting the development units 20, the circulation tanks 110, the ink tanks 131, the carrier tank 140, the waste ink disposal tank 150 and the filtering means 160.

Here, the developer liquid refers to ink having about 2–4 wt % toner concentration, obtained by mixing concentrated ink containing about 9 wt % powdered toner supplied from the ink tanks 131 with a liquid carrier supplied from the carrier tank 140 in a predetermined ratio. Here, the colors of the developer liquid are determined according to pigments composing the toner.

The circulation tanks 110 are installed under the corresponding development units 20, and supply developer liquid through the respective jet portions 120 to the development units 20, and re-accommodate the residual developer liquid after it is used for development, so that the accommodated developer liquid D is continuously supplied to the development gap G during development.

A concentration sensor 111 for sensing the concentration of the accommodated developer liquid D is installed in each circulation tank 110, and a lower limit level sensor 112 for sensing the accommodated amount of the developer liquid D is installed in the outer lower portion of the circulation tank 110.

Here, a plurality of filters 115 for removing foreign matter contained in the developer liquid are preferably comprised so that the developer liquids delivered into the respective development units 20 are recovered in the respective circulation tanks 110. The plurality of filters 115 are installed in corresponding developer liquid recovery paths 113. Although the filters 115 are indicated in the drawing as if they were separated from the development units 20, they may be incorporated in the lower portions of the development units 20. In this case, the filters 115 are replaced together with the development units 20 when necessary.

Each of the jet portions 120 includes a jet path 121 through which the developer liquid is supplied, a jet pump 123 installed in the jet path 121 for pumping the developer liquid, and a nozzle 125 installed at the stage of the development gap G of the jet path 121 for jetting the developer liquid to the development gap G.

Each of the ink tanks 131 is fixed on the corresponding circulation tank 110. Therefore, the concentrated ink accommodated in the ink tank 131 is supplied to each circulation tank 110 through a concentrated ink supply path 136 connected between the respective circulation tanks 110 by its own weight. Here, a valve 137 is installed in each concentrated ink supply path 136 so as to adjust the amount of the concentrated ink supplied. Also, functional parts, e.g., an agitator 132 for agitating the concentrated ink, are installed in each ink tank 131.

The concentrated ink contained in the ink tank 131 is supplied to the circulation tank 110 through the concentrated ink supply path 136. When the concentrated ink is used up, concentrated ink is supplied from the refill ink cartridge 133 through a concentrated ink refill path 134 (that is, 134Y, 134M, 134C and 134K). The refill ink cartridge 133 is disposable and is detachably installed in a printer body (not shown), and functional parts such as an agitator, are not included therein. Since the refill ink cartridge 133 is installed only when the concentrated ink is fully filled in the ink tank 131, it does not occupy additional space in the printer body.

Here, the refill ink cartridges 133 are separately provided for the respective colors. Also, the refill ink cartridges 133 corresponding to the colors may be simultaneously installed in the printer body. Alternatively, the refill ink cartridges 133 corresponding to the respective colors may be installed on a mounting portion 101 formed on the printer body.

Figure 3:
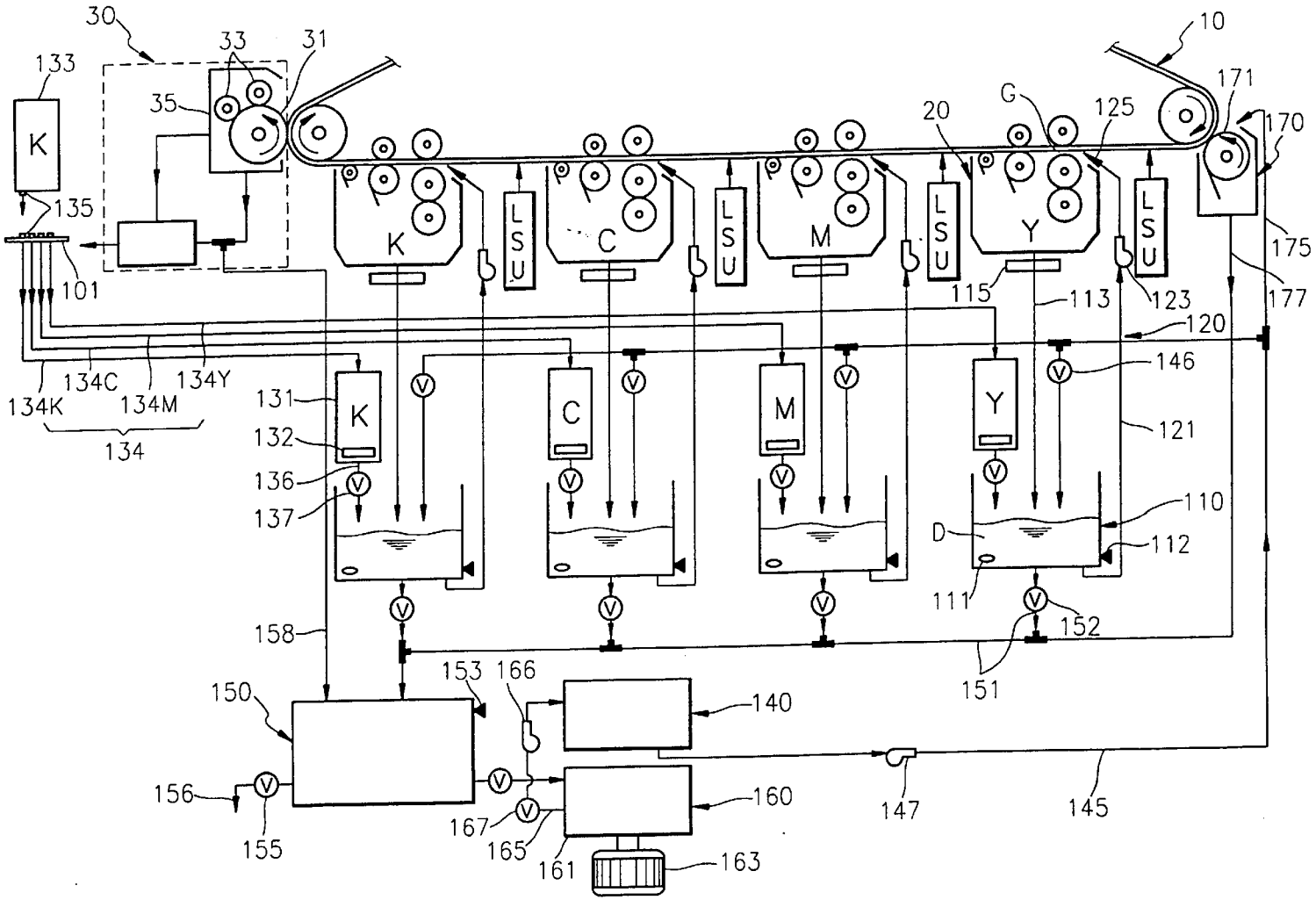
FIG. 3 is a schematic diagram of an ink delivery system for a liquid electrophotographic color printer according to another embodiment of the present invention.

FIGS. 2 and 3 illustrate an example of mounting a refill ink cartridge for black ink on the mounting portion 101 for the purpose of refilling the concentrated ink to the black (K) ink tank 131.

A shut-off valve 135 is opened/being shut according to detachment of the refill ink cartridge 133, is installed in the concentrated ink refill path 134 to supply the concentrated ink in one direction. Also, when the refill ink cartridge 133 is displaced, that is, positioned below ink tank 131, unlike in the drawing, a pump (not shown) for pumping the concentrated ink may be further included in the concentrated ink supply path 136.

The carrier tank 140 is fixed in the printer body and the carrier to be supplied to the circulation tank 110 is stored therein. Here, since the respective development units 20 use the same carrier, one carrier tank 140 is provided. The carrier stored in the carrier tank 140 is supplied to each circulation tank 110 through a carrier supply path 145 branching off to the respective circulation tanks 110. Therefore, the carrier in the carrier tank 140 is gradually consumed, and the consumed amount of the carrier is refilled by the carrier supplied via the filtering means 160 to be described later. As described above, since the carrier in the carrier tank 140 is refilled, a separate carrier cartridge for replacement is not necessary.

A plurality of valves 146 for adjusting the amount of the carrier to be supplied to the respective circulation tanks 110 and a pump 147 for pumping the carrier to be supplied, are included in the carrier supply path 145.

The waste ink disposal tank 150 connected to the respective circulation tanks 110 by an ink exhaust path 151 collects the waste ink in the circulation tanks 110. A plurality of valves 152 for controlling the amount of the developer liquid exhausted from the circulation tanks 110 are installed in the ink exhaust path 151.

An upper limit level sensor 153 for sensing the upper limit level of the waste ink is installed at the waste ink disposal tank 150 so that overflow of waste ink accommodated in the waste ink disposal tank 150 can be prevented. Some of the waste ink accommodated in the waste ink disposal tank 150 is exhausted to the outside of the printer body through an outlet 156 opened/shut by a valve 155, and most of the waste ink accommodated in the waste ink disposal tank 150 is exhausted to the filtering means 160.

Also, a carrier recovery path 158 connected between the drying/condensing unit 30 to the waste ink disposal tank 150, for recovering the carrier condensed by the drying/condensing unit 30 in the waste ink disposal tank 150, may be further installed. Here, the drying/condensing unit 30 includes a drying roller 31 for absorbing the carrier remaining on the photoreceptor belt 10, regeneration rollers 33 for regenerating the absorbed liquid carrier into a vapor carrier by heating the drying roller 31 while rotating in contact with the drying roller 31, and a condenser 35 for condensing the vapor carrier. The carrier condensed by the condenser 35 is recovered in the waste ink disposal tank 150 through the carrier recovery path 158.

Here, the carrier recovery path 158 can be disposed between the condenser 35 and the carrier tank 140 so that the condensed carrier can be directly recovered in the carrier tank 140, instead of the waste ink disposal tank 150.

The filtering means 160 disposed between the waste ink disposal tank 150 and the carrier tank 140, filters the waste ink supplied from the waste ink disposal tank 150.

The filtering means 160 includes a filtering container 161 accommodating the waste ink supplied from the waste ink disposal tank 150 for filtering the accommodated waste ink, a driver 163 for rotating the filtering container 161 so that the waste ink in the filtering container 161 is separated into a toner and a carrier by a centrifuge, and a carrier refill path 165 through which the carrier separated in the filtering container 161 is delivered to the carrier tank 140. Here, since the toner is solid particles precipitated in the filtering container 161 during the centrifuge operation, pure carrier can be filtered. Since the filtering container 161 and the driver 163 can be implemented by a well-known centrifuge, the detailed explanation thereof will be omitted herein.

The carrier refill path 165 includes a pump 166 connected between the filtering container 161 and the carrier tank 140 for pumping the separated carrier, and a valve 167 for controlling the supply amount and timing of the carrier.

Hereinbelow, the operation of the ink delivery system for a liquid electrophotographic color printer according to an embodiment of the present invention will be described with reference to FIG. 2.

During a development mode, while the developer liquid in each circulation tank 110 is delivered to each development unit 20 through the jet portion 120, a color image is developed corresponding to the latent electrostatic image formed on the photoreceptor belt 10 by the LSU. At this time, the concentration sensor 111 and the lower limit level sensor 112 installed the circulation tank 110 sense the concentration and amount of the developer liquid remaining in the circulation tank 110. If a concentration of the developer liquid is less than or greater than the allowed range is sensed by the concentration sensor 111, the amount of necessary concentrated ink supplied from the ink tank 131 is supplied to the circulation tank 110 through the concentrated ink supply path 136, and the carrier supplied from the carrier tank 140 is supplied to the circulation tank 110 through the carrier supply path 145.

At this time, the amount exceeding the capacity of the circulation tank 110 is exhausted to the waste ink disposal tank 150 through the ink exhaust path 151.

The ink delivered from the circulation tank 110 through the ink exhaust path 151 and the carrier delivered from the drying/condensing unit 30 through the carrier recovery path 158 are recovered in the waste ink disposal tank 150.

Most of the waste ink in the waste ink disposal tank 150 is exhausted to the filtering means 160 and is separated into the carrier and the toner by the centrifugal operation in the filtering means 160. Since a trivial amount of solid toner is precipitated in the filtering container 161, the centrifuge operation is not affected by the precipitated toner. The separated carrier is delivered to the carrier tank 140 through the carrier refill path 165 to then be used in refilling the consumed carrier. Here, the carrier used for refilling is separated from the concentrated ink and is continuously supplied by the respective refill ink cartridge 133. The concentrated ink in the ink tank 131 is continuously consumed, and refilled from the concentrated ink supplied from the refill ink cartridge 133 through the concentrated ink refill path 134.

A filter 115 is installed between the development unit and the circulation tank 110 and filters foreign matter contained in the developer liquid.

FIG. 3 is a schematic diagram of an ink delivery system for a liquid electrophotographic color printer according to another embodiment of the present invention. Here, the same reference numerals as those in FIG. 2 represent the same elements and thus a detailed explanation thereof will be omitted.

The feature of this embodiment is in that there is further provided a cleaning means for cleaning the photoreceptor belt 10 using a carrier supplied from a carrier tank.

The cleaning means includes a cleaning unit 170 having a cleaning roller 171 rotating in contact with a photoreceptor belt 10, for cleaning the photoreceptor belt 10, a cleaning carrier supply path 175 through which the carrier is supplied to the cleaning roller 171, and a carrier exhaust path 177 through which the carrier in the cleaning unit 170 is delivered to the waste ink disposal tank 150.

The cleaning carrier supply path 175 branches off from the carrier supply path 145 and is a path through which the carrier pumped by the pump 147 of the carrier supply path 145 is supplied to the cleaning unit 170. The carrier exhaust path 177 is a path through which the carrier used in cleaning is delivered to the waste ink disposal tank 150 by natural gravitational flow due to the fact that the cleaning unit 170 is installed to be higher than the waste ink disposal tank 150. Although the carrier exhaust path 177 is shown connected to the ink exhaust path 151 in FIG. 3, this is only an illustrative example, and the carrier exhaust path 177 may be connected directly to the waste ink disposal tank 150.

As described above, since the ink delivery system for a liquid electrophotographic color printer according to the present invention has a carrier tank and a carrier recovery system for supplying the carrier, a separate carrier cartridge is not necessary.

If an ink supply portion is separated into an ink tank and a refill ink cartridge, it is not necessary to replace the ink tank during development. Thus, special consideration of the user's convenience is not necessary, and spatial availability of a printer body is enhanced. Also, when the ink is used up, functional parts are not necessarily replaced together with the ink cartridge, which means that low cost disposables can be utilized.

It is conceivable that numerous modifications may be made to the ink delivery system for the liquid electrophotographic color printer of the present invention without departing from the spirit and scope of the invention as defined in the following claims.

What is claimed is:

1. A delivery system for a liquid electrophotographic color printer which is operative to deliver a developer liquid of a predetermined concentration, the developer liquid being a mixture of a toner and a liquid carrier to a plurality of development units, comprising:

a plurality of circulation tanks connected to the respective development units and in which the developer liquids to be supplied to the development units are stored;

a plurality of jet portions disposed between the respective circulation tanks and the respective development units, for jetting the developer liquid in the circulation tanks to development gaps in the respective development units;

a plurality of ink tanks incorporated in a printer body and in which concentrated ink having different colors is stored;

a plurality of agitators installed in the respective ink tanks for agitating the concentrated ink;

a refill ink cartridge detachably installed in the printer body, for refilling the concentrated ink consumed in the ink tanks through a concentrated ink refill path;

a plurality of concentrated ink supply paths through which the concentrated ink accommodated in the respective ink tanks is supplied to the corresponding circulation tanks;

a carrier tank fixed in the printer body and in which the carrier to be supplied to the respective circulation tanks is stored;

a carrier supply path through which the carrier in the carrier tank is supplied to the respective circulation tanks;

a waste ink disposal tank connected to the respective circulation tanks by an ink exhaust path, for collecting the waste ink in the circulation tanks; and filtering means installed between the waste ink disposal tank and the carrier tank, for filtering the waste ink in the waste ink disposal tank to supply the carrier to the carrier tank.

2. The ink delivery system according to claim 1, wherein each of the plurality of circulation tank further comprises:

a concentration sensor for sensing a concentration of the developer liquid accommodated in the circulation tank; and a level sensor for sensing a lower limit level of the accommodated developer liquid.

3. The ink delivery system according to claim 1, wherein the filtering means comprises:

a filtering container accommodating the waste ink supplied from the waste ink disposal tank, for filtering the accommodated waste ink;

a driver for rotating the filtering container so that the waste ink in the filtering container is centrifuged to then be separated into a toner and a carrier; and a carrier refill path through which the carrier separated in the filtering container is delivered to the carrier tank.

4. The ink delivery system according to claim 1, further comprising:

a carrier refill path installed between a drying/condensing unit and the waste ink disposal tank, for recovering the carrier condensed by the drying/condensing unit after being used for development.

5. The ink delivery system according to claim 1, further comprising:

a filter installed in each of the developer liquid carrying paths between the development units and the circulation tanks, for filtering foreign matter contained in the developer liquid.

6. The ink delivery system according to claim 1, further comprising:

cleaning means for cleaning a photosensitive medium using the carrier supplied from the carrier tank.

7. The ink delivery system according to claim 1, wherein the cleaning means comprises:

a cleaning unit having a cleaning roller for cleaning the photosensitive medium while rotating in contact with the photosensitive medium;

a cleaning carrier supply path connected to the carrier supply path, for supplying the carrier to the cleaning roller; and a second carrier exhaust path for delivering the carrier in the cleaning unit to the waste ink disposal tank.

* * * * *